US005127292A

United States Patent [19]

Kapoor

[11] Patent Number: 5,127,292

[45] Date of Patent: Jul. 7, 1992

[54] APPARATUS AND METHOD FOR CUTTING AND REMOVING THIN TRANSVERSE STRIPS FROM A MOVING WEB

[76] Inventor: Vinod Kapoor, 59 Heritage Dr., Pleasantville, N.Y. 10570

[21] Appl. No.: 600,733

[22] Filed: Oct. 22, 1990

[51] Int. Cl.[5] ..... B26D 7/18

[52] U.S. Cl. ..... 83/24; 83/98; 83/100; 83/349

[58] Field of Search ..... 83/24, 99, 100, 346, 83/349, 98

[56] References Cited

U.S. PATENT DOCUMENTS

| | | | |
|---|---|---|---|
| 3,166,965 | 1/1965 | Stemmler | 83/175 |
| 3,209,630 | 10/1965 | McCartan | 83/100 |
| 3,274,871 | 9/1966 | Ehlscheid | 83/99 |
| 3,680,419 | 8/1972 | Stoop | 83/98 |
| 4,037,501 | 7/1977 | Gladow | 83/100 |
| 4,409,870 | 10/1983 | Rymik et al. | 83/100 |
| 4,425,829 | 1/1984 | Kranik et al. | 83/98 X |
| 4,537,588 | 8/1985 | Ehlscheid et al. | 83/98 X |

*Primary Examiner*—Frank T. Yost
*Assistant Examiner*—Eugenia A. Jones
*Attorney, Agent, or Firm*—Nolte, Nolte and Hunter

[57] ABSTRACT

In a printed web strip cutting machine, the cutting cylinder is divided diagonally by a formed septum into two isolated chambers. The cylinder is mounted on hollow shafts connected to an exhaust system. Each hollow shaft communicates with only one of the two chambers to draw a current of air into the chamber between the spaced cutting knives. The web support beneath the cylinder has vents to provide air jets to lift the severed strip into the air current between the knives.

17 Claims, 6 Drawing Sheets

APPARATUS AND METHOD FOR CUTTING AND REMOVING THIN TRANSVERSE STRIPS FROM A MOVING WEB

This invention relates to an improved gap-cutting apparatus and method of the type used to cut and remove a narrow strip across an incoming web.

BACKGROUND

In web-fed printing presses, a continuous web of paper is printed with repeating images. These images have a certain non-printed space due to inherent features of locking a plate and a blanket onto the press cylinders. It is therefore an advantage in the cutting device to have an ability to trim off a narrow transverse strip of paper corresponding to the non-print area of the press. It is also desirable to produce a finished and trimmed product in a finishing line wherein a transverse strip of paper must be cut and removed from a continuous web to produce the desired product size.

There are several devices currently available to cut and remove such strips. One such device is described in U.S. Pat. No. 4,409,870 to Rynik et al. wherein a pair of knives mounted on a hollow rotating cylinder act against a stationary knife to cut the paper. As the paired rotary knives are close to each other, they produce a thin strip of paper which is sucked somewhat radially into the cylinder by a draft produced by an exhaust blower. The cut strips travel through the cylinder bore axially to the exhaust connection. This type of device is quite convenient compared to others requiring several movable components to hold and dispose of the strip. However, the mechanism of Rynik et al. suffers from several drawbacks that has limited its use. The major problem lies in the fact that several openings around the cylinder communicate with a central bore to which the vacuum exhaust source is connected. And as the cylinder must be supported in bearings, the size of exhaust connection is limited by the size of the bearing journal. To produce an adequate velocity of flow for conveying the cut strips through such an exhaust connection, a very large vacuum blower is needed. However, as the crosssectional area of openings connected to the central bore is much larger than the size of exhaust connection at cylinder end, there is a large drop in vacuum inside the cylinder. In order to alleviate this, the Rynik patent requires the use of a stationary sleeve inside the cylinder to limit the cylinder openings communicating with central bore. In actual practice, a stationary sleeve inside a rotating cylinder poses several problems with cut strips jamming up in the clearance between sleeve and cylinder. Such a device is also ineffective for high speed operation due to the fact that the knife openings are exposed to vacuum for a time interval smaller than needed to accelerate and move the cut strip from the point of cut to the central bore. The other drawback of the prior art consists of a poor aerodynamic flow pattern inside the cylinder with pockets of stagnant or low air velocity, so that at higher speeds, the cut strips tend to fly out of the cylinder due to centrifugal force. Due to these limitations, the cutting devices in accordance with the above described prior art have been limited to low speed operations.

It is accordingly the object of my invention to provide a rotary knife cylinder with improved aerodynamic design to enable cutting and removal of the strips at higher speeds and requiring a smaller sized blower by efficient utilization of vacuum.

It is an object of my invention to provide an improved cutting cylinder with no stagnant pockets and a streamlined air flow pattern with uniformly increasing cross-sectional area of flow in the direction of flow. It is also an object of my invention to permit use of a smaller sized cylinder due to the improved air flow pattern or alternatively to reduce the evacuated area within the cylinder.

It is a further object of my invention to have the greatest velocity of air flow at the beginning of the transport of the removed strip with a gradual reduction in velocity toward the delivery end of the cylinder produced by the gradual streamlined increase in cross-sectional area in the direction of air flow within the cylinder as well as beyond the cylinder.

It is also an object of the invention to reduce or eliminate articulations and seals between, for example, a stationary baffle and a moving cylinder as required in the prior art.

It is also an object of my invention to permit cutting and removal of thin strips at higher speeds by providing an air-jet assist in lifting the cut strip into the cylinder cavity. These and other objects and advantages of this invention will become apparent when taken in conjunction with the following drawings.

Figure 1:
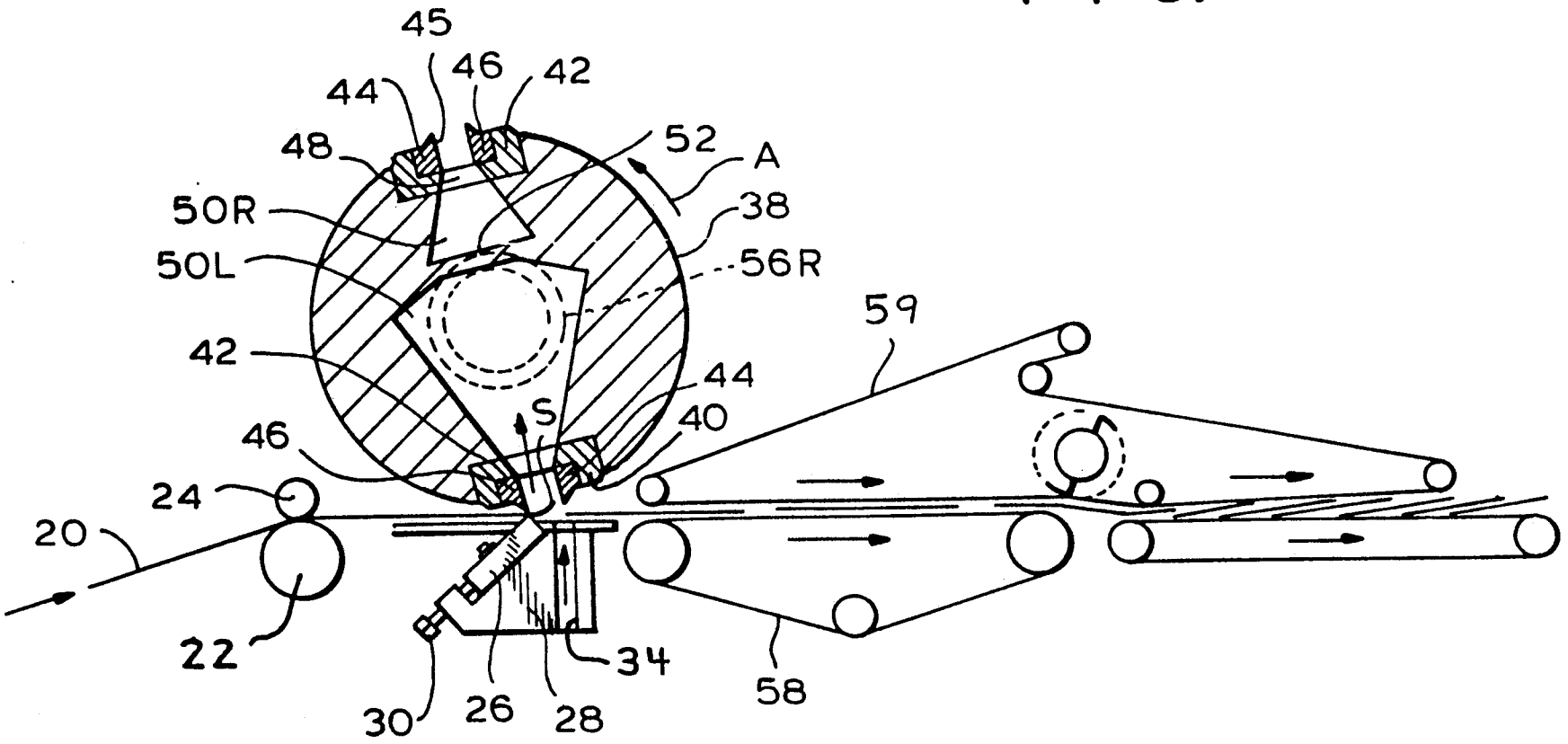
FIG. 1 is a schematic sectional view.
Figure 2:
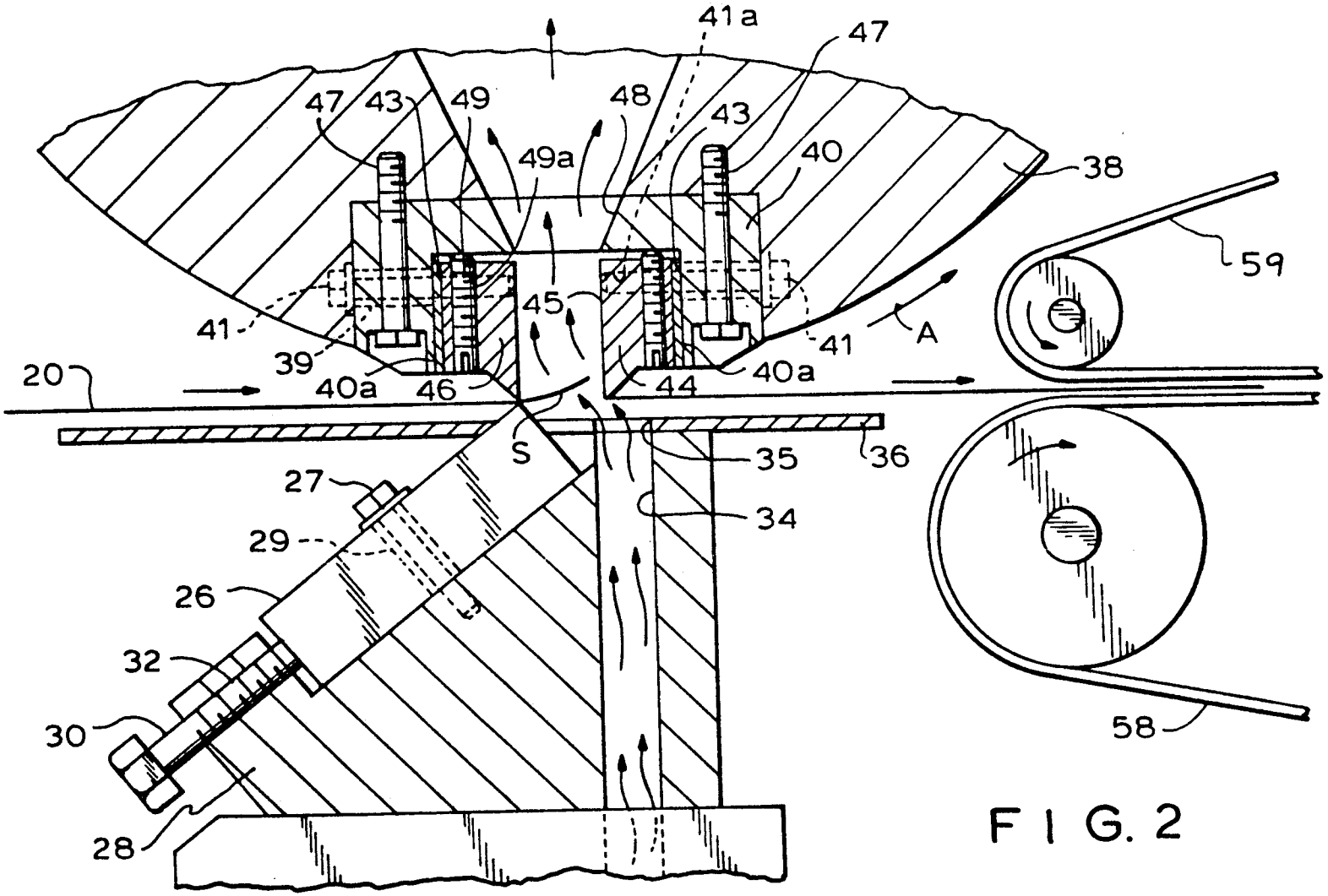
FIG. 2 is an enlarged fragmentary section showing cutting of a web strip.

Referring to FIGS. 1 and 2, there is shown a printed web 20 drawn through feed rollers 22 and 24. Web 20 passes over bottom knife 26 secured in the base block 28. Knife 26 is adjusted by screws 30 threaded into bores 32 of block 28. Knife 26 is secured and locked in its adjusted position by screws 27 which pass through slots 29 of knife 26 and are threaded into tapped bores in block 28. Forward of the knife 26 there is formed in the block 28 a plurality of holes 34 whose upper end communicates with holes 35 in support plate 36 and whose lower end communicates with the ambient atmosphere.

Above knife 26 and openings 35, a transverse cylinder 38 supports a pair of diametrically positioned knife holders 40, 42 each carrying a pair of spaced knives 44, 46. Holders 40 are secured to cylinder 38 by bolts 47. Knives 44, 46 are radially adjustable with respect to cylinder 38 and one or both knives 44 (46) are adjustable (as shown) toward or away from the other knife 46 (44). Radial adjustability is by set screws 49 threaded in bores **49*a* in the knives 44, 46. Adjustability is permitted by slots 39 receiving locking bolts 41 threaded into tapped bores 41*a* in knives 44, 46. Shims 43 between wall 40*a* and knife 44 (46) adjust the spacing or gap 45 between the knives 44, 46**.

Figure 3:
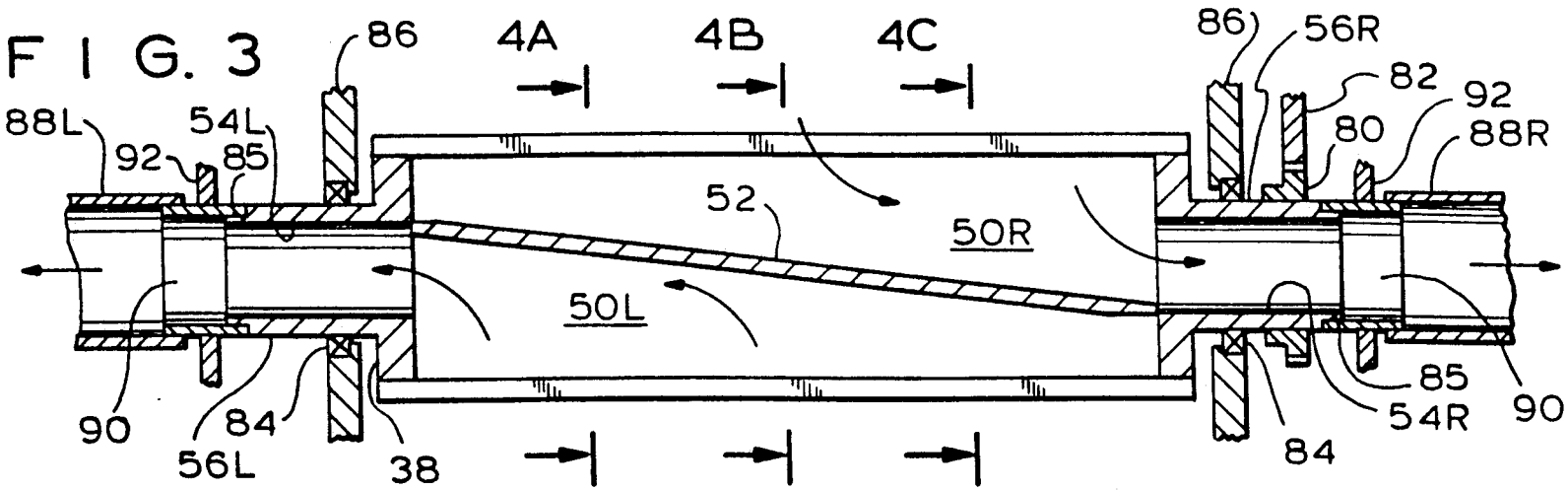
FIG. 3 is a detail in section of a cutting cylinder omitting the knives and knife holders for clarity.

Referring now to FIG. 3, it will be seen that the central chamber or cavity 37 of the cylinder 38 is diagonally divided by a shaped septum 52. The cavity or sub-chamber 50L communicates with the leftward coaxial chamber 54L (as viewed in FIG. 3) formed in the supporting shaft 56L of cylinder 38. Likewise, a cavity or sub-chamber 50R communicates with the coaxial cavity 54R in the supporting shaft 56R. The septum 52 is welded to or otherwise integral with the cylinder 38 so that there is no communication between sub-chambers 50L and 50R. The position and conformation of septum 52 is such that the cross-sectional area of the chambers 50L and 50R uniformly increase in the direction of flow to provide uniform air velocity despite an increased volume of air moving through chambers 50L, 50R in the respective contrary directions of the several arrows shown in FIG. 3. By increased air volume, I refer to the incremental air entering along a gap 45 progressively from left to right in chamber 50R or from right to left in cavity 50L (FIG. 3).

The coaxial cavities 54L and 54R, in shafts 56L and 56R, are in communication with a source of vacuum through hoses or tubes 88L, 88R which convey the cut strips S to a conventional trim removal system. The cavities 54L and 54R may also be constructed to provide a slowly and smoothly increasing cross-sectional area in the direction of flow to advantageously slow the velocity of the strips S as they progress axially. Shafts 56L and 56R rotatably support cylinder 38 driven in any suitable manner or as hereinafter described.

Referring again to FIGS. 1 an 2, it will be seen that the counterclockwise rotation (arrows A as viewed in FIGS. 1 and 2) of the cylinder 38 will successively bring the spaced knives 44, 46 across the lower knife 26 to severe a narrow strip S from the web 20. The speed of the cylinder 38 is such that the cutting edges of knives 44, 46 move at a higher velocity than web 20. This prevents bunching of the web and also reduces the size of the strip S to less than the spacing of knives 44, 46. Further, the location of edge 26 prior to the point of tangency of the web path with the cylinder (the six o'clock position) causes the knives 44, 46 to move in their arc downwardly through the web. This assists both in cutting and in placing the strip S into the gap 45 between the knives 44, 46. The severed product is accelerated and shingled in a well known manner by belts 58 and 59.

It should be noted that in my preferred embodiment of the invention but one opening 45 is connected via a chamber 54L, 54R to each end of cylinder 38, thus avoiding loss of vacuum inherent in the prior art construction. Thus, while there are two openings 45 in cylinder 38, each is independent of the other and therefore full use is made of the vacuum drawing, at one end of the cylinder, air and the cut strip into cylinder cavity 50L or 50R, as the case may be. Thus, no other open port reduces the vacuum applied to cut strip S. Also the air flow pattern thru 50L or 50R is uniform and laminar due to the gradual increase in the cross-sectional area of flow from the gap 45 to the discharge end of cylinder 38. Air flow velocity is maximum at gap 45. These structure and flow pattern permit use of a smaller vacuum or exhaust blower than heretofore employed in such strip cutters for a given web speed.

In another embodiment of my invention, a cylinder 60 with four openings and four pairs of knives is provided with a special septum that connects two openings to each streamlined passage 63 (61) connected to one end of the cylinder 60.

Figure 4C:
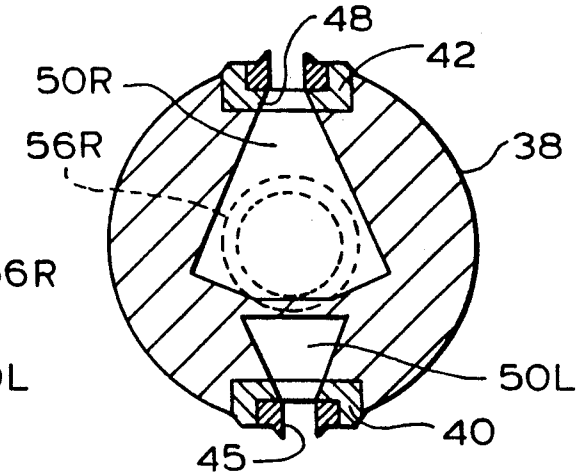
FIGS. 4A, 4B and 4C are sections taken on lines 4A—4A, 4B—4B and 4C—4C, respectively of FIG. 3.
Figure 4B:
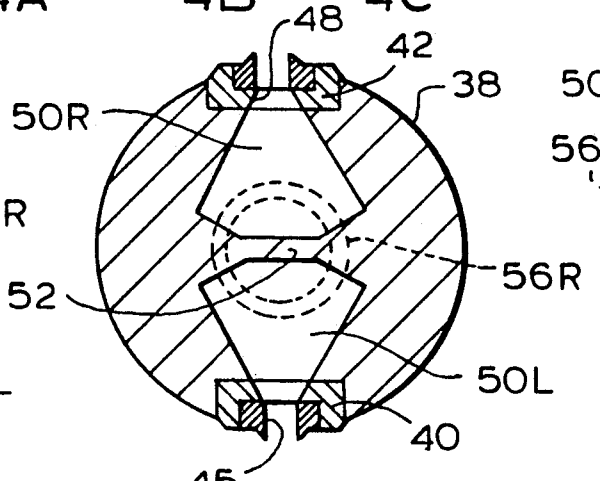
Figure 4A:
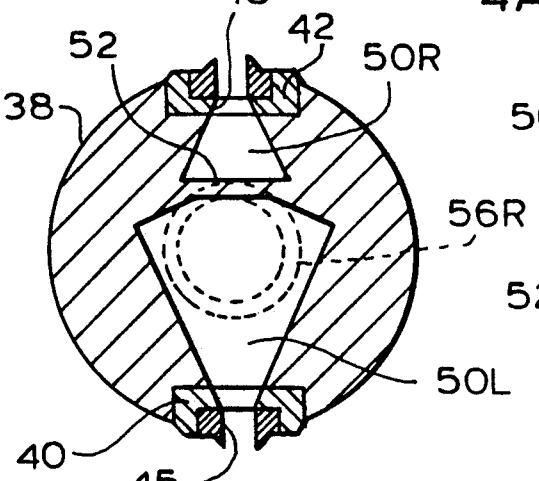
Figure 5A:
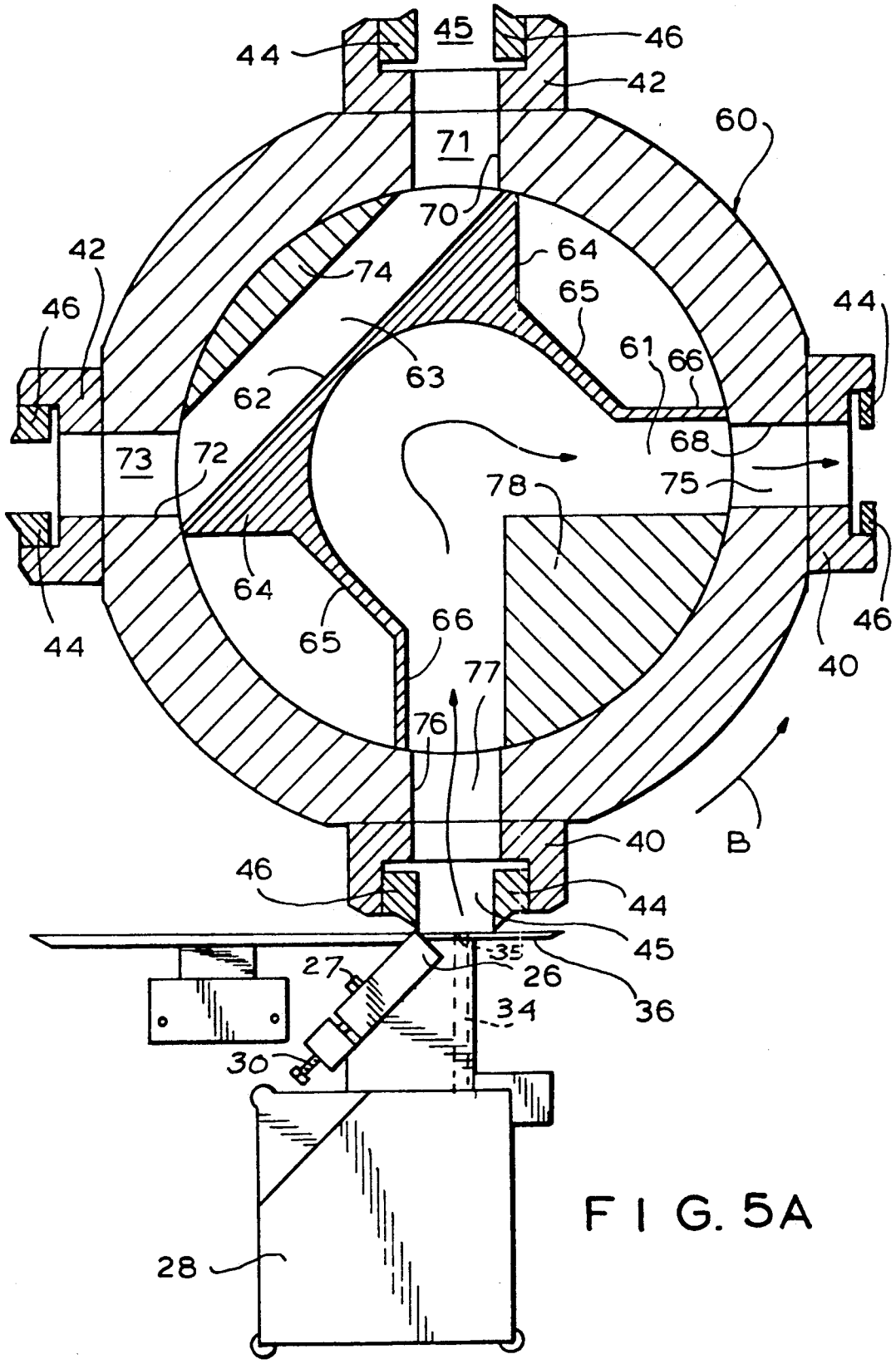
FIGS. 5A, 5B and 5C are sectional views of another embodiment of the cutting cylinder taken at positions along the modified cylinder corresponding to FIGS. 4A, 4B and 4C, respectively.
Figure 5B:
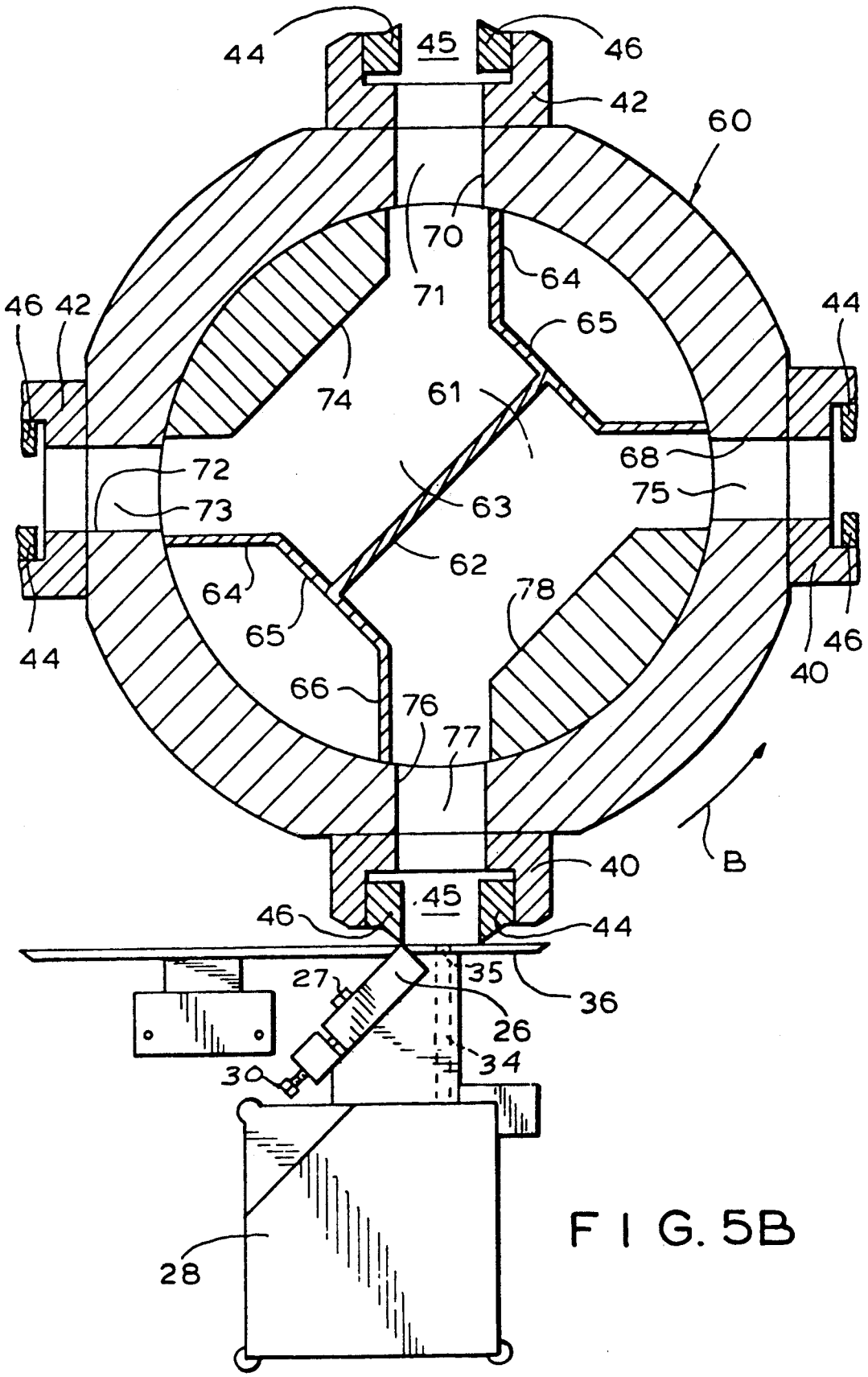
Figure 5C:
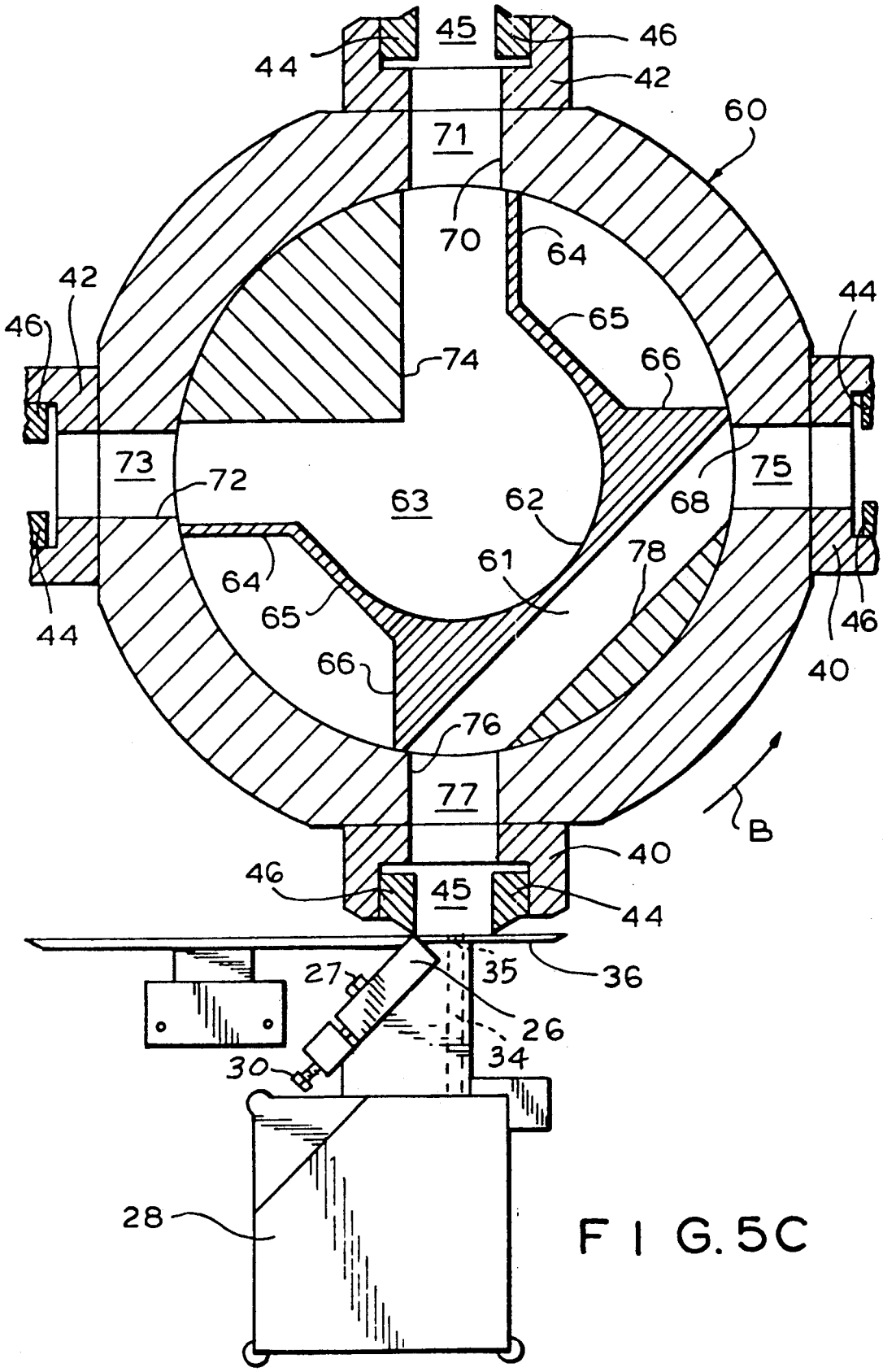

FIGS. 5A, 5B and 5C show cross sectional views of this embodiment and correspond respectively to the sections shown in FIGS. 4A, 4B and 4C for cylinder 38. The cylinder 60 has four openings 71, 73, 75, 77. The openings communicate with the gap 45 between four pairs of knives 44, 46 secured in four holders 40, 42 in the manner illustrated for cylinder 38 in FIG. 2. The formed septum 62 forms the throats 63, 61. Throat 63 connects with both openings 71, 73 while throat 61 communicates with both openings 75, 77. Passage 61 communicates with a leftward cavity such as shown as 54L in FIG. 3 for cylinder 38. Passage 63 communicates with a rightward cavity similar to 54R in FIG. 3. This embodiment still reduces by more than one-half the flow of air required for a cylinder with four pairs of knives. A hollow cylinder of the prior art with four pairs of knives is drawing on four openings (three non-working) while lifting a strip S. With my structure, only two of four openings are involved for each cut and the throats 63, 61 are reduced in size and streamlined.

Septum 62 of cylinder 60 is shaped with wings 64, 65 and 66. Like septum 52 of FIG. 3, septum 62 divides the cylinder 60 into two sub-chambers or throats 63, 61 which are not in communication with each other. Wings 64 span the leading side 72 of opening 73 and the trailing side 70 of opening 71. In like fashion, the wings 66 span the leading side 68 of opening 75 and the trailing side 76 of opening 77. Inserts 74 and 78 on the inside wall of cylinder 60 complete the streamlining and reduction in cross sectional area of the throats 63 and 61, respectively. Otherwise, the cylinder 60 has the same supporting and evacuating structures as cylinder 38, namely, axial shafts 56L and 56R.

Referring back to FIG. 3, the drive mechanism and application of vacuum used for both cylinder 38 and cylinder 60 is illustrated. A driven gear 80 is secured to shaft 56R. Gear 80 is driven by drive gear 82 from the web feeding drive means (not shown). Shafts 56L and 56R are rotatably supported in bearings 84 in supporting frame 86 mounted to the base plate of the machine by structure not shown. Secured about reduced portions 85 of shafts 56R and 56L are cylindrical sleeves 90 held by brackets 92 secured to the base plate of the machine by structure not shown. Tubes 88L, 88R apply suction to cavities 54L and 54R respectively and hence to cavities 50L and 50R of cylinder 38 (FIG. 3) or throats 61 and 63, respectively, of cylinder 60.

The ratio of drive to gear 80 is such that the knife cylinder 38 (60) is rotated so that the peripheral speed of knives 44, 46 is greater than the speed of web 20 and hence the width of the strip cut by a pair of knives 44, 46 is smaller than the gap 45 between the knives 44, 46. The vacuum applied to each end of the cylinder draws the cut chips into the space between the knives 44, 46. As the cut strip has to be accelerated against gravity into the cylinder cavity, an additional lift is provided by air-jets created by the vacuum between the knives 44, 46 facing a series of communicating holes or slots 34, 35 in the bottom block 28 and support plate 36, respectively. As these air jets are created only during passage of the knives 44, 46, they are momentary and do not disturb the web when a pair of knives are not at the cutting location.

It will, of course, be appreciated that as the cylinder 38 (60) rotates, cavities 50L (61) and 50R (63) alternate with each other in rotary position.

The web 20 now severed by the removal of the strip S is fed through speeded up feed belt 58, 60 to shuffle successive sections on top of preceding sections for eventual stacking in a well known manner.

I claim:

1. A mechanical method of severing a thin strip from a continuous web, comprising feeding the web forwardly across an edge, revolving at least two pairs of spaced knives in a circular orbit above said web so that each pair successively co-acts with said edge to sever strips from said web, applying suction to a first pair of said knives in a first direction axial the path of said orbit, applying suction to a second pair of said knives in an axial direction contrary to said first axial direction, positioning a septum diagonally from one end of said first pair of knives to the opposite end of said second pair of knives to separate the strips severed by the first pair of knives from the strips severed by the second pair of knives, and conducting ambient air beneath said web to said strips upon severance by one of said pair of knives co-acting with said edge.

2. In a web cutting machine constructed and arranged to sever thin transverse strips from a moving web comprising a cylinder mounted for rotation adjacent and transverse said web, a diagonal septum extending diagonally through said cylinder and constructed and arranged to divide the interior of said cylinder into a first chamber and a second chamber, said chambers in at least one static position of said cylinder being positioned so said first chamber is adjacent said web and said second chamber is distal from said web, both chambers extending transverse to said web, means communicating with said first chamber to draw air substantially axially from first said chamber, means communicating with said second chamber to draw air substantially axially from said second chamber in a direction contrary to the direction of air drawn by said first communicating means, a first elongated opening in said cylinder radially communicating with said first chamber and running substantially parallel the axis of said cylinder, a second elongated opening in said cylinder radially communicating with said second chamber and running substantially parallel the axis of said cylinder, a first pair of spaced parallel knives mounted to said cylinder to form a gap in communication with said first elongated opening and a second pair of spaced parallel knives mounted to said cylinder to form a gap in communication with said second elongated opening whereby strips severed by said spaced knives during rotation of said cylinder will be conveyed by drawn air via said gaps and openings into and axially from said chambers.

3. A device as set forth in claim 2 and further characterized by an axial shaft on said cylinder having a hollow interior in communication with at least one of said chambers.

4. The device of claim 2 characterized in that said communication means include hollow axial supports at each end of said cylinder.

5. A device as set forth in claim 2 and further characterized by a stationary support supporting said web as it passes adjacent said cylinder, said support being on the side of said web opposite said cylinder, at least one channel formed in said support communicating the supported side of said web with a source of air to conduct air through said support when one of said openings of one of said chambers with its associated spaced knives upon severing a strip from said web is at a position opposite said channel whereby said strip is propelled into said one chamber.

6. A device substantially as set forth in claim 5 and further characterized by a stationary edge underlying said web and positioned, in the direction of movement of said web, prior to the point of tangency of said web to said cylinder, said underlying edge being constructed and arranged to co-act successively with each of said spaced knives during rotation of said cylinder to sever said web.

7. A device as set forth in claim 2 and further characterized by a stationary support supporting a stationary knife located underneath said cylinder, said support being on the side of said web opposite said cylinder, with a series of holes formed in said support to conduct ambient air through said support when one of said openings in one of said chambers and its associate spaced knives upon severing a strip from said web is at a position opposite said series of holes whereby said strip is propelled into said one chamber.

8. A device substantially as set forth in claim 2 and further characterized in that said communicating means include a pair of axial hollow shafts each constructed and arranged to communicate independently with one of said chambers, said shafts communicating in turn with a suction source to draw air from said chambers.

9. A device substantially as set forth in claim 2 and further characterized in that at least one of said spaced knives has adjusting means to adjust the space therebetween.

10. A device in accordance with claims 2 or 9 and further characterized in that said knives may be radially adjusted to said cylinder to adjust the distance the knife edge extends from the axis of said cylinder.

11. A machine in accordance with claim 2 further characterized by an edge mounted to co-act with said spaced knives upon rotation of said cylinder to sever a strip from a web.

12. A device substantially as set forth in claim 2 and further characterized in that said cylinder is constructed and arranged to rotate at a speed that the knives mounted thereon have a circumferential velocity exceeding the linear velocity of said web as said knives move with said cylinder.

13. A web severing device, means to feed a web over a support, means to sever said web on said support and means to convey severed portions of said web from said support, said support having an edge underlying said web, a cylinder mounted for rotation above said web and transverse thereto, said cylinder having a chamber formed therein, a co-axial opening at each end of said cylinder, a septum dividing said chamber into two sub-chambers, said septum being positioned diagonally from one end of said cylinder to the other, each of said sub-chambers having at least one opening communicating with the circumference of said cylinder, said openings running substantially the length of said cylinder, a pair of spaced cutting knives mounted in each of said openings to co-act during rotation of said cylinder with said underlying edge to sever a strip of web therebetween, and a vacuum source to vacuumize said chambers, said source communicating with said co-axial openings at the ends of said cylinder to draw air through said sub-chambers whereby a strip of material severed from said web is drawn into a respective sub-chamber and said strip is conveyed longitudinally from said cylinder.

14. A device in accordance with claim 13 and further characterized by at least one opening in said support communicating with the atmosphere and subsequent to said edge in the direction of web feed whereby the strip of material severed from said web is drawn into a respective sub-chamber by a jet of air entering said vacuumized chamber from said opening in said support.

15. The mechanism in accordance with claim 13 and further characterized in that each of said chambers has a shaped insert to limit the volume of said sub-chambers, said insert being secured to the internal circumference of said sub-chamber and tapering in cross-sectional size from small to large in the direction of flow of air through said vacuumized chambers.

16. A device substantially as set forth in claim 13 and further characterized in that said edge beneath said web is positioned in advance of an imaginary vertical plane passing through the axis of said cylinder, said web feeding means feeding said web substantially horizontally across said edge and said cylinder being rotated so that said pairs of knives co-act with said edge and pass downwardly through said web beyond said edge in the direction of movement of said web.

17. The device of claim 13 further characterized in that each of said sub-chambers has two openings communicating with the circumference of said cylinder and spaced cutting knives in each of said openings.

* * * * *

UNITED STATES PATENT AND TRADEMARK OFFICE

CERTIFICATE OF CORRECTION

PATENT NO. : 5,127,292

DATED : July 7, 1992

INVENTOR(S) : Vinod Kapoor

It is certified that error appears in the above-identified patent and that said Letters Patent is hereby corrected as shown below:

Column 5, line 27, "first said" should be --said first--.

Column 6, line 25, in the first instance, "to" should be --in--.

Signed and Sealed this

Seventh Day of September, 1993

Bruce Lehman

*Attest:*

BRUCE LEHMAN

*Attesting Officer*

*Commissioner of Patents and Trademarks*